United States Patent [19]

Brandl

[11] Patent Number: 4,669,785

[45] Date of Patent: Jun. 2, 1987

[54] CUTTING MACHINE

[75] Inventor: Erich Brandl, Knittelfeld, Austria

[73] Assignee: Voest-Alpine Aktiengesellschaft, Austria

[21] Appl. No.: 773,365

[22] Filed: Sep. 6, 1985

[30] Foreign Application Priority Data

Sep. 20, 1984 [AT] Austria ..... 2999/84

[51] Int. Cl.[4] ..... E21C 35/20

[52] U.S. Cl. ..... 299/68; 299/76; 299/64

[58] Field of Search ..... 299/67, 64, 68, 75, 299/76, 18, 78

[56] References Cited

U.S. PATENT DOCUMENTS

| | | | |
|---|---|---|---|
| 2,986,385 | 5/1961 | Densmore | 299/68 |
| 3,776,592 | 12/1973 | Ewing | 299/75 X |
| 3,907,368 | 9/1975 | Galis | 299/57 |
| 4,088,371 | 5/1978 | LeBegue et al. | 299/76 |
| 4,310,199 | 1/1982 | Freed, Jr. et al. | 299/76 |

FOREIGN PATENT DOCUMENTS

| | | | |
|---|---|---|---|
| 2324661 | 12/1974 | Fed. Rep. of Germany | 299/75 |
| 2519825 | 11/1976 | Fed. Rep. of Germany | 299/64 |

*Primary Examiner*—Stephen J. Novosad
*Assistant Examiner*—Michael A. Goodwin
*Attorney, Agent, or Firm*—Cushman, Darby & Cushman

[57] ABSTRACT

A cutting machine includes a universally swivellable cutting arm (6) having rotatably supported on its free end at least one cutting head (10, 11). A backwardly conveying screw conveyor (8, 9) is connected with the cutting arm (6) at both sides of the cutting arm (6). Each has its front end (12) located within the area of the cutting head (10, 11). The conveyor screws (8, 9) are surrounded by a housing which is open at the side turned away from the cutting arm (6). These conveyor screws (8, 9) take up the heap of debris during horizontal lateral movement and backwardly convey the material from the mine face (21) to a removal means (26) being arranged, for example, on the loading ramp (25).

7 Claims, 2 Drawing Figures

CUTTING MACHINE

BACKGROUND OF THE INVENTION

The invention refers to a partial cutting machine comprising a universally swivellable cutting arm having rotatably supported on its free end at least one cutting head. It is an object of the invention to remove with such a cutting machine the cut material by means of simple equipment immediately from the drift face and the invention essentially consists in that at both sides of the cutting arm there is connected with the cutting arm a backwardly conveying screw conveyor having its front end located within the area of the cutting head. In view of the screw conveyors being laterally arranged on the cutting arm, one screw is, on account of the horizontal movement of the cutting arm, forced into the heap of debris which is backwardly conveyed by the screw conveyor away from the mine face. The arrangement according to the invention is particularly suitable for a drift advancing process in which first a calotte or dome is cut and then a step underneath is cut after having cut the calotte or vault overhead the step. When cutting the calotte, there is formed a step onto which falls the heap of debris and from which the heap of debris is backwardly conveyed by the screw conveyors for removal in the usual manner from the drift floor. The screw conveyors provide, however, also advantages when cutting the full drift cross section or when cutting step remaining after having cut the dome above the step. In each case it is possible to convey the heap of debris in a backward direction by means of the screw conveyors. The invention provides the advantage that operation need not be interrupted, because the screw conveyors are, on account of the lateral advancing movement of the cutting arm, forced into the heap of debris and, thus, convey the heap of debris in a backward direction during the cutting operation.

SUMMARY OF THE INVENTION

According to the invention, the screw conveyors are surrounded by a housing being open along its side located remote from the cutting arm. The laterally free accessible screw entrenches itself into the heap of debris during the lateral movement of the cutting arm and backwardly conveys the heap of debris. Conveniently, the housing encloses the conveyor screw at its upper side, at its side facing the cutting arm and at its lower side. The front ends of the conveyor screws extend as near as possible to the mine face. In an arrangement in which at both sides of the cutting arm a cutting head is rotatably supported around an axis transversely extending relative to the axis of the cutting arm, the front ends of both screw conveyors are, according to the invention, preferably located closely behind the cutting heads. In this manner, the cut material is already received where it is generated. In this case according to the invention, the axes of both screw conveyors extend, as seen in a top plan view, preferably obliquely and converge in a forward direction toward the axis of the cutting arm. The screws laterally receive the heap of debris and, on account of the oblique position of the screws, the cut material immediately arrives at the sides of the screws. This does, however, also consider the fact that the cutting arm also increases in width in the backward direction.

The arrangement is conveniently such that the rear ends or discharge ends, respectively, of both screw conveyors are located above at least one removal means of the cutting machine. In this manner, removal of the heap of debris is substantially simplified. In this case, the discharge ends of both screw conveyors may be located above the loading ramp of the cutting machine.

BRIEF DESCRIPTION OF THE DRAWINGS

In the drawing, the invention is schematically explained with reference to an embodiment.

DETAILED DESCRIPTION OF THE PREFERRED EMBODIMENT

Figure 1:
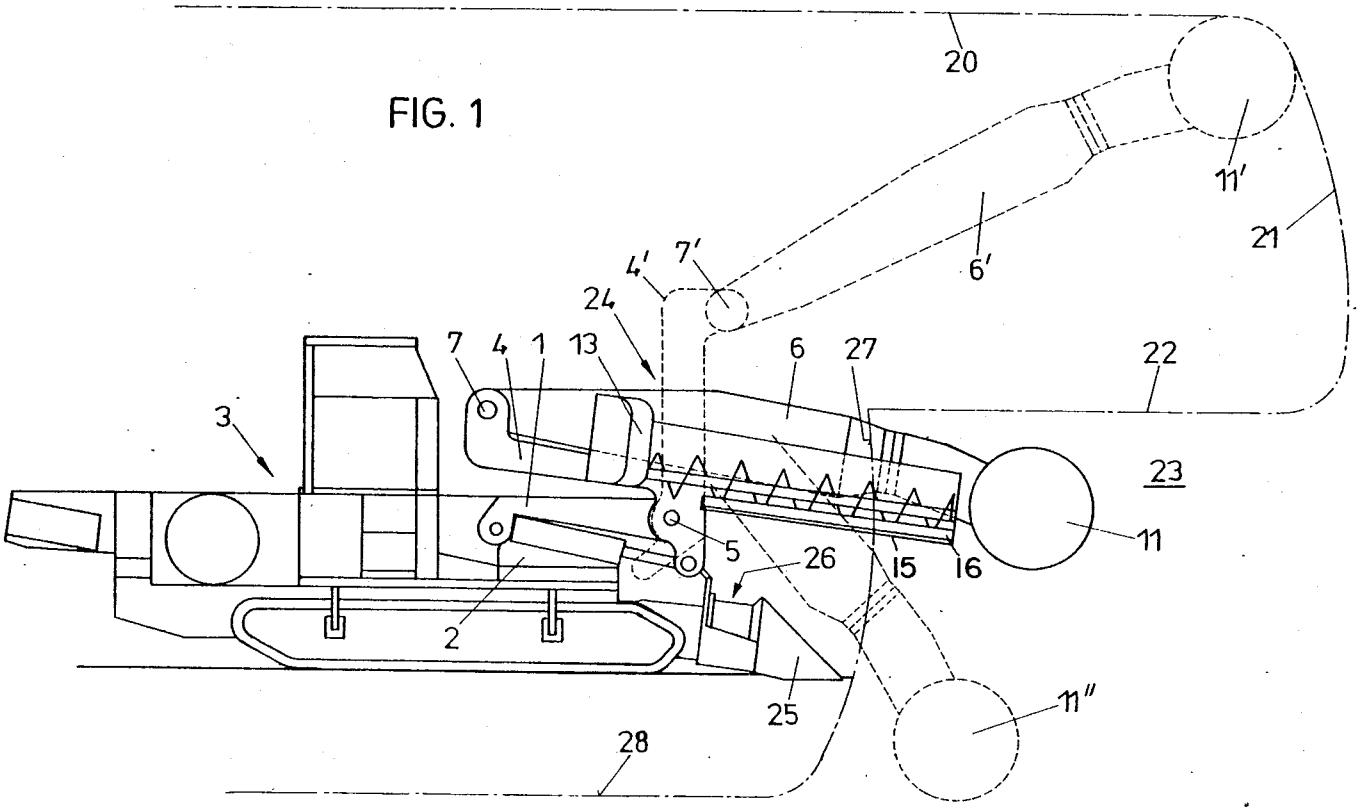
FIG. 1 shows a side elevation of the cutting machine together with the cut longitudinal profile of the excavation.

A rocker arm 4 is pivotally supported on the swivelling bolster 1 of the traversing gear 2 of a cutting machine 3 for upward swivelling movement around a horizontal swivelling axis 5. The cutting arm 6 is supported for being upwardly swivellable around a horizontal swivelling axis 7, noting that in the upwardly swivelled position of the rocker arm 4 the horizontal swivelling axis 7 assumes the inclined position 7' and the rocker arm 4 assumes the upright position 4'. In this position, the cutting arm 6 is designated by 6' and the cutting heads 10, 11 are designated by 11'. In the position shown in full lines, the cutting arm 6 rests on the rocker arm 7.

At both sides of the cutting arm 6, there is arranged screw conveyors 8 and 9 which is fixed to the cutting arm 6. Said both screw conveyors 8 and 9 are obliquely arranged for converging in a direction to the front end of the cutting arm 6. The cutting tool is formed of two cutting heads 10 and 11 which rotate around an axis transversely extending relative to the cutting arm, and the front ends 12 of both screw conveyors 8 and 9 are located closely behind the cutting heads 10 and 11. There is also a housing 13 for the drive means of the screw conveyors 8 and 9.

The screws 14 of both screw conveyors 8 and 9 are surrounded at the bottom side and at the side facing the cutting arm by the housing of the screw conveyors 8 and 9. The lower wall 15 of the housing has a sharpened edge 16 for taking up the heap of debris and for supplying it to the screws 14. The side 17, facing the cutting arm, of the housing is of solid design so that the heap of debris conveyed by the screw 14 is guided. The screws 14 are freely accessible at the side located remote from the cutting arm 6, so that the heap of debris can be supplied to the screws 14. When swivelling the cutting arm in the direction of the arrow 18, there becomes effective the screw conveyor 9, while the screw conveyor 8 becomes effective when swivelling the cutting arm in the direction of the arrow 19.

In the shown position 6' of the cutting arm 6, the calotte defined by the lines 20, 21 and 22 (FIG. 1) is cut free, thereby leaving step 23. When advancing the calotte, there is thus formed the step 23 with the top 22, the cut material being removed from this step 23 both screw conveyors 8 and 9 when swivelling the cutting arm. At the discharge ends 24 of both screw conveyors 8 and 9, the bottom of the lower wall 15 is interrrupted so that the cut material may exit through the discharge ends 24. If the cut material falls onto the loading ramp 25, it is flipped over onto scraper conveyor 26 which move the cut material to the center thereof, from where the material falls down through an opening (not shown) onto a removal conveyor which transports the cut material through the center of the cutting machine 3 to the rear end of the cutting machine 3 and to a further drift conveyor (not shown).

Figure 2:
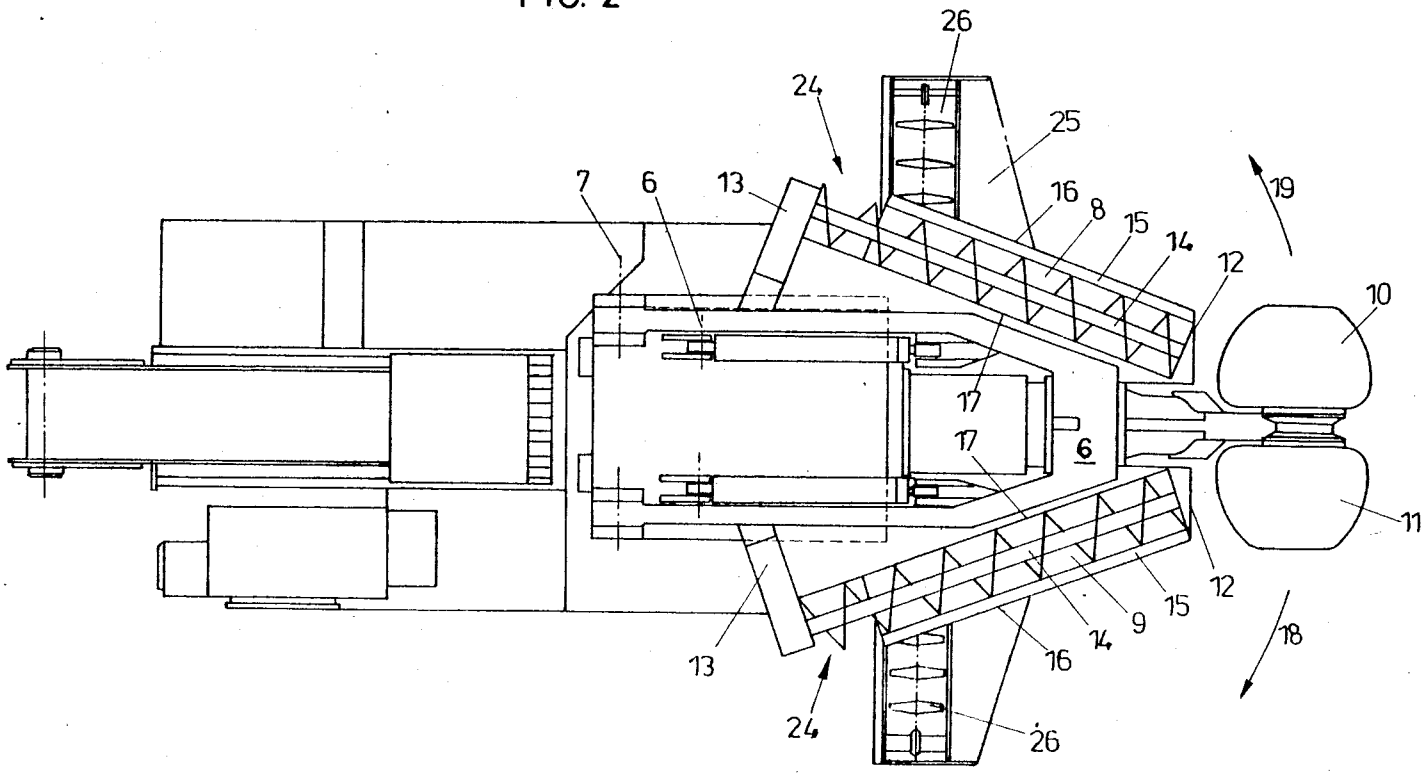
FIG. 2 shows a top plan view.

The details of the operation as to how the cut material gets onto the loading ramp 25 when the cutting arm is in either position 11' or 11'' will now be described. By viewing FIG. 1, it becomes clear that, in position 11' of the cutting head, the rocker arm 4 is swivelled around the axis 5 and that in position 4' the cut material is thrown out in front of the loading ramp 25 via the discharge end 24 that is shown in FIG. 2. In FIG. 1, it is clear here, too, that the position 11'' of the cutting arm, when lowered down to the front edge of the loading ramp 25, can be reached only when the rocker arm 4 is simultaneously swivelled around the axis 5. Such a swivelling of rocker arm 4 around axis 5 leads automatically to the discharge end 24 being moved forwardly so that, even in such a lowered position 11'' for the cutting arm, the discharge ends 24 of the screw conveyors 8 and 9 will certainly be already above the loading ramp 25.

Front face indicates the limiting area of the step 23. The step 23 can be cut if the cutting arm 6 assumes a position approximately corresponding to the position shown in full lines. The screw conveyors 8 and 9 are also effective when cutting the step 23. The undercut 28 can be made with the cutting heads 10 and 11 assuming the position 11''.

What is claimed is:

1. A partial cutting machine for cutting material, comprising:

a universally swivellable cutting arm having rotatably supported on its free end at least one cutting head, a pair of backwardly conveying screw conveyors, each having its front end open and being located closely behind the cutting head, and housing means, surrounding each of the pair of screw conveyors and being open at each outer side located remote from the cutting arm, for discharging cut material rearwardly and laterally outwardly.

2. Partial cutting machine comprising:

a universally swivellable cutting arm having rotatably supported on its free end at least one cutting head, a pair of backwardly conveying screw conveyors, each having its front end open and being located closely behind the cutting head, and housing means for surrounding each of the pair of screw conveyors and being open at each outer side located remote from the cutting arm, characterized in that the housing means encloses each screw conveyor at its upper side, at its side facing the cutting arm, and at its lower side.

3. Cutting machine as claimed in claim 2, further comprising:

means for removing cut material rearwardly, said removing means being located below rear discharge end of said pair of screw conveyors.

4. Cutting machine as claimed in claim 3, further comprising:

ramp means for loading the removing means with cut material, saidramp means also being located below rear discharge ends of said pair of screw conveyors.

5. Partial cutting machine comprising:

a universally swivellable cutting arm having rotatably supported on its free end at least one cutting head, a pair of backwardly conveying screw conveyors, each having its front end open and being located closely behind the cutting head, housing means for surrounding each of the pair of screw conveyors and being open at each outer side located remote from the cutting arm, and means for rotatably supporting the cutting head for rotation around an axis transversely extending relative to a longitudinal axis of the cutting arm, characterized in that longitudinal axes of said pair of screw conveyors obliquely extend and converge with the longitudinal axis of the cutting arm at a point forward of the cutting head.

6. Cutting machine as claimed in claim 5, further comprising:

means for removing cut material rearwardly, said removing means being located below rear discharge ends of said pair of screw conveyors.

7. Cutting machine as claimed in claim 6, further comprising:

ramp means for loading the removing means with cut material, said ramp means also being located below rear discharge ends of said pair of screw conveyors.

* * * * *